US005152434A

United States Patent [19]

Birmelin

[11] Patent Number: 5,152,434

[45] Date of Patent: Oct. 6, 1992

[54] DISPENSER WITH PUMP DEVICE

[75] Inventor: Uwe Birmelin, Auggen, Fed. Rep. of Germany

[73] Assignee: MegaPlast Dosiersysteme GmbH & Co., Wuppertal, Fed. Rep. of Germany

[21] Appl. No.: 568,594

[22] Filed: Aug. 16, 1990

[30] Foreign Application Priority Data

Aug. 29, 1989 [DE] Fed. Rep. of Germany ..... 3928524

[51] Int. Cl.[5] ..... B65D 37/00

[52] U.S. Cl. ..... 222/207; 222/257

[58] Field of Search ..... 222/207, 209, 256, 380, 222/383, 385, 386, 387, 633, 634, 257

[56] References Cited

U.S. PATENT DOCUMENTS

| | | | |
|---|---|---|---|
| 4,050,613 | 9/1977 | Corsette | 222/383 |
| 4,120,429 | 10/1978 | Vignot | 222/207 |
| 4,301,948 | 11/1981 | Czech et al. | 222/341 |
| 4,685,594 | 8/1987 | Czech | 222/383 |
| 4,732,549 | 3/1988 | von Schuckmann | 222/207 |
| 4,863,070 | 9/1989 | Andris | 222/207 |

FOREIGN PATENT DOCUMENTS

| | | | |
|---|---|---|---|
| 1806461 | 3/1970 | Fed. Rep. of Germany . | |
| 8800880 | 7/1989 | Fed. Rep. of Germany . | |
| 3817632 | 11/1989 | Fed. Rep. of Germany | 222/209 |
| 1302037 | 7/1962 | France . | |
| 2021983 | 7/1970 | France . | |

*Primary Examiner*—Michael S. Huppert
*Assistant Examiner*—Kenneth Bomberg
*Attorney, Agent, or Firm*—Martin A. Farber

[57] ABSTRACT

A dispenser has a pump device (4) with two hollow pistons (9, 10) which are displaceable coaxially with respect to each other, and wherein one piston is seated at the pump base while the other piston is seated on an actuating button (30). The button continues into a mouthpiece (29) and is surrounded by a bellows (B) which provides an axial restoring force. The bellows (B) forms a piston ring (K) at a distance (A) from the upper end of the actuating button-side hollow piston (9), and slides on a wall surface (9) of the button side hollow piston.

6 Claims, 3 Drawing Sheets

30
36
P
29
23
31
V 2
35
3
28
34
20
38'
27
21
39
B
25
26
9
8
32
37
33
3
9'
24
38
4
K
38"
A
K
18
y
17
10
14
V1
10'
11
22
2
12
1
13
15
19
16
5'
1'
6
x
5
7
5''

DISPENSER WITH PUMP DEVICE

FIELD AND BACKGROUND OF THE INVENTION

The present invention relates to a dispenser which is provided with a pump device and in which two hollow pistons are provided which can be displaced coaxially one within the other and wherein one piston is seated on the pump base and the other piston is seated on an actuating button which extends into a mouthpiece. The hollow pistons are surrounded by a bellows which causes axial restoration, and which extends from the pump base up to the upper region of the hollow piston on a side of the actuating button.

A dispenser of this type is disclosed in French Patent 1 302 037. There a part of the mass which flows centrally through the hollow pistons also passes through the annular space formed by the surrounding bellows. For this purpose both hollow pistons, which can be displaced with respect to each other, have passage openings. As a result thereof, the substance comes into maximum surface contact with the bellows. Depending on the bellows material used and on the type of the substance, this can result in impairment of the taste or, in general, of a qualitative nature. It also frequently can be noted with such dispensers that the substance dries out and, in particular, also loses its aroma due to insufficient sealing.

SUMMARY OF THE INVENTION

It is therefore the object of the invention so to develop a dispenser of the type described with respect to its pump device in a manner which is easy to manufacture and advantageous in use that the contact or wetting surfaces are minimized with respect to the substance.

As a result of the invention, there is obtained a dispenser of this type which is of increased value in use. The bellows material which is in any event flexible by its very nature now acts, broadening its basic function, also as a piston ring. The impairments described above are in this way substantially eliminated. The restoring forces are furthermore free. The braking effect of the substance is absent. This disadvantage was noted in particular when a highly viscous mass had to be dispensed such as toothpaste, mustard, color paste, adhesive, etc. As a result of the feature of the invention that at a distance from the upper end of the hollow piston on the side of the actuating button the bellows forms a piston ring which slides on the wall surface of said hollow piston, contact with the substance is practically limited to the freely extending dimension of the flank of the piston ring facing the pump chamber. In addition to the maximum tightness and favorable sliding guidance which can also be obtained, there is the advantage of greater independence with respect to tolerances. As in the case of sealing lips formed on the article from the start, no longer is precision required which would be excessive for a mass produced article of this kind.

Due to its material and also due to its special cross-sectional structure, the piston ring already has a maximum flexibility in order to compensate for the customary deviations. This property is, however, also optimized by the fact that the piston ring lies directly above the rim edge of the hollow piston on the side of the pump base. The corresponding free projection guarantees sensitive mobility when the piston ring applies and adapts itself to the corresponding slide surface. Nevertheless, the immediate proximity to the rim edge results in a good operative association which is achieved due to the correspondingly harder material.

It is in this connection, furthermore, advantageous that the root of the piston ring which must be created by a corresponding thickening of material rests on the rim edge. There is, therefore, always present a defined position for the piston ring. It is furthermore favorable for the piston ring to be equipped with two piston ring-sealing lips located axially one behind the other. This results in maximum tightness so that even critical substances can be dosed using the dispenser of the invention.

In terms of association it is furthermore advantageous that the root of the piston ring proceeds from a plug-on collar of the bellows seated on the wall surface of the pump base-side hollow piston. This collar which extends axially contrary to the sealing ring which extends transversely inward can be attached to the pump base-side hollow piston simply by placing it on. Another advantageous development consists in the two sealing lips diverging with respect to each other and leaving a trapezoidal free space between themselves, the folded bellows wall of the bellows extending therefrom extending approximately in the direction toward the divergence apex. As a result, the force is directed at a neutral point when the bellows is compressed; there is no lifting off of one or the other sealing lip. Furthermore, the divergence apex is located above the rim edge so that forces resulting from this movement also do not flow into the plug-on collar and deform it.

BRIEF DESCRIPTION OF THE DRAWINGS

The object of the invention is explained in greater detail below with reference to an embodiment shown in the drawings, in which.

DETAILED DESCRIPTION OF THE PREFERRED EMBODIMENT

Figure 1:
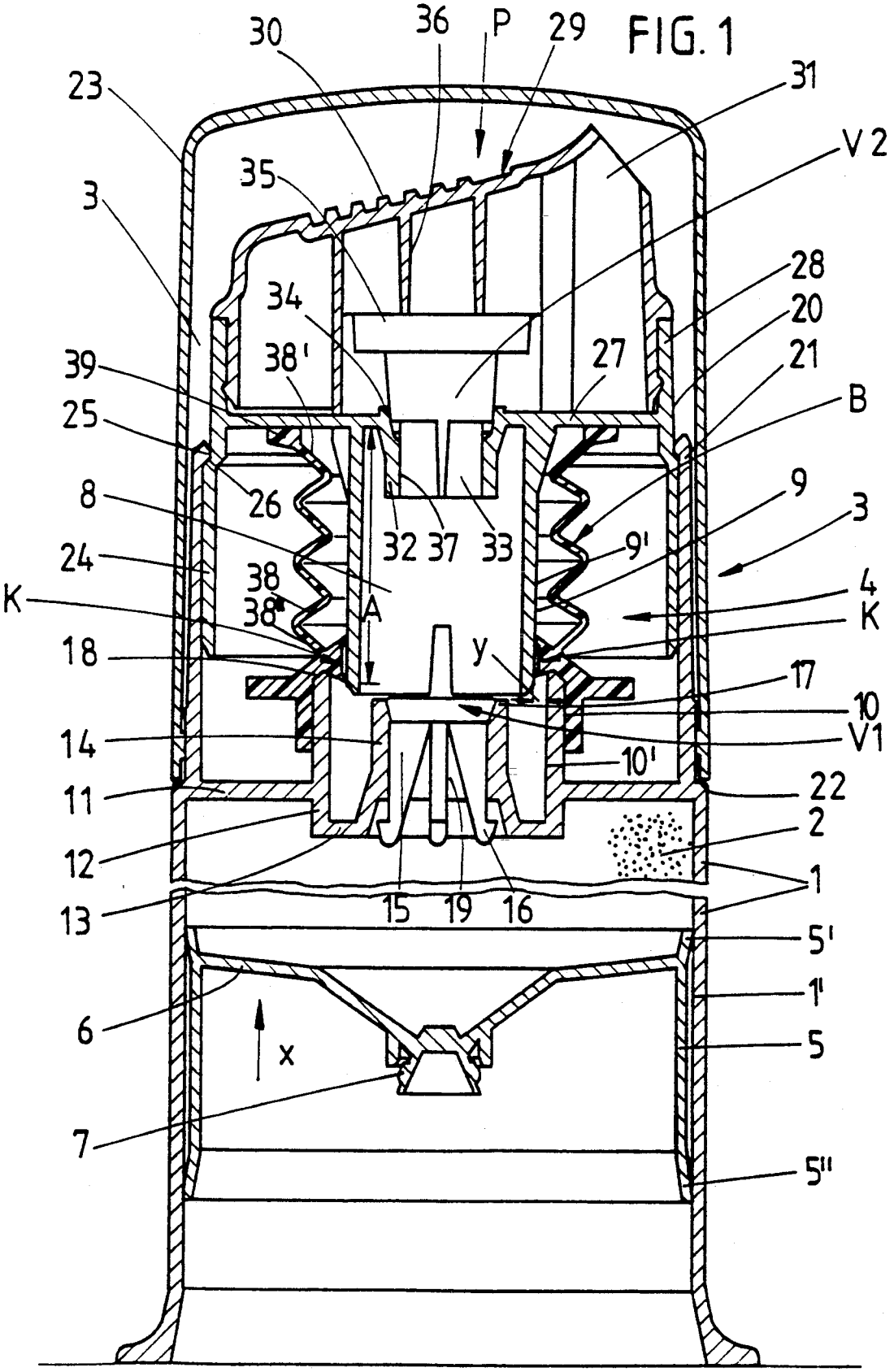
FIG. 1 shows the dispenser developed in accordance with the invention in its basic position, in vertical cross-section.
Figure 2:
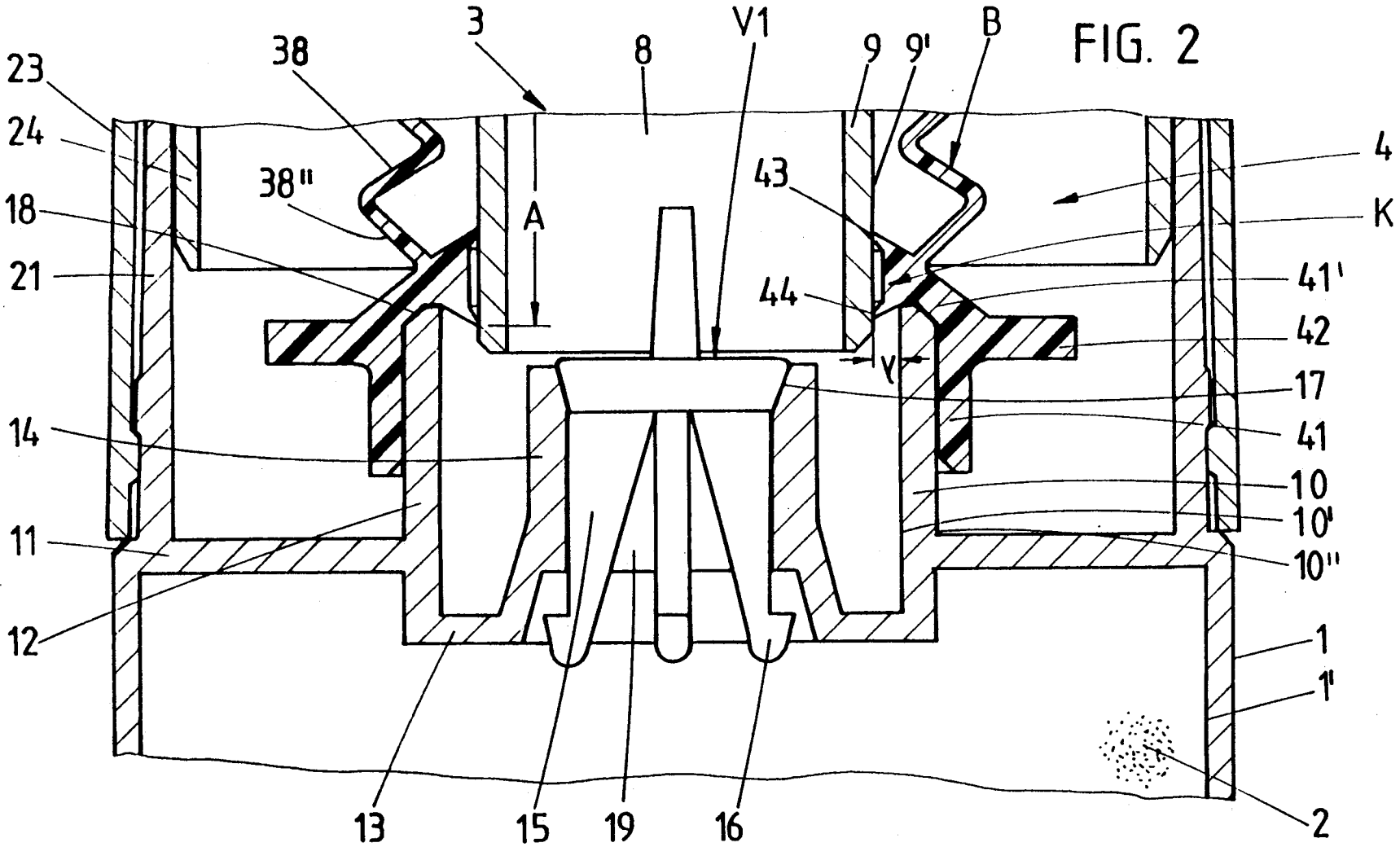
FIG. 2 is an enlarged detail in the region of the two ends of the hollow pistons which are directed towards each other.

The dispenser shown has a housing 1 which is developed as an elongated cylinder. The greater part of its volume is reserved for a pasty composition 2 as a substance which is to be dispensed. It can, for instance, consist of mustard.

A pump device 4 arranged in the head 3 of the dispenser serves to dispense the composition 2. The pump device can be actuated by hand.

By actuation of the pump device 4 a follow-up piston 5, which is displaceable stepwise in the dispensing direction indicated by the arrow x, is moved. The rim lips 5' and 5'' of said follow-up piston are guided in sealing fashion along the cylindrical inner wall 1' of the housing. The follow-up piston 5 is cup-shaped. The bottom 6, however, is somewhat indented with respect to the one rim lip 5' pointing in the direction of the arrow x. The bottom 6 forms a central passage opening with a closure plug 7 formed thereon. The closure plug is pushed into the tightly sealing basic position only if any air, possibly entrapped behind the pasty composition 2, is displaced through the passage opening. For manufacturing reasons the simultaneous molding on of the closure plug 7 is a fundamental advantage.

The housing 1 is therefore open towards the bottom. The filling of the housing 1 takes place there.

Displacement of the follow-up piston 5 in a specific direction can be further optimized by a clamping mechanism, not shown in detail, for instance in the form of the so-called clamping module which is fixed centrally in the back of the piston 5, protrudes with star-shaped spring tongues beyond the rim of the lower rim lip 5" and rests in the manner of a climbing pole in the inner wall 1' of the housing. The pump device 4 forms a cental pump space 8 which is formed by hollow pistons 9, 10 which are arranged axially displaceable with respect to each other and which can be pushed one inside the other.

The hollow piston 10 acting practically as a stationary cylinder extends from a cover 11 on the top of the housing. It consists of a cylindrical annular wall 12 which extends to below the level of the cover and which passes on the bottom into a horizontal bottom 13. An upwardly directed collar 14 extends from the bottom 13. The annular wall of the collar extends concentrically to and at a radial distance from the surrounding annular wall 12 of the hollow piston 10.

An inlet valve V1 of limited axial displacement is seated in the collar 14. This is a disk valve with top-side bevel and bottom-side cross-shaped shaft 15 which secures the containment of the valve body within the collar 14 by outwardly directed hooks 16. The upper inner rim of the collar 14 has a funnel-shaped valve seat surface 17 open towards the top. For the spring-like engagement of the hooks 16, the cross arms of the cross-shaped shaft 15 are centrally undercut so that resilient fingers which extend freely downwardly are practically present.

The collar 14 terminates at an axial distance in front of the rim edge 18 of the pump base-side hollow piston 10, i.e. the cylinder, which edge extends somewhat beyond the collar in upward direction.

A valve-controlled, central passage opening 19 of the collar 14 connects the pump space 8 to the storage space for the pasty composition 2 of the housing 1.

The upper part 20 of the pump which is associated with the above-described bottom part of the pump has the hollow piston 9. The latter is of cylindrical shape and is guided in a cup-shaped extrusion 21 which extends beyond the cover 11 of the housing 1 in upward direction. The extrusion 21 is slightly recessed with respect to the cylindrical wall of the housing 1 so that an annular shoulder 22 remains. The lower edge of a cup-shaped protective cap 23, which covers the head 3 of the dispenser (see FIG. 1), comes against the annular shoulder as a limiting stop.

The upper part 20 of the pump consists of a cylindrical, downward directed guide section 24 which slides over the inner surface of the cup-shaped extrusion 21. The corresponding vertical and/or axial movement for the pump stroke is limited by stops in both directions. A stop limitation in actuating direction (opposite that of the arrow x) results from a utilization of the horizontally extending cover 11 against which the lower front edge of the guide section 24 strikes. The stop limitation in the opposite direction results from an internal annular collar 25 on the upper free end of the guide section 24, the annual collar 25 cooperating with an annular shoulder 26 of the guided part, i.e. of the upper part 20 of the pump.

The basic position in this respect is under spring load. For this there is used a bellows B which spreads the two hollow pistons 9, 10 apart in axial direction, in which basic position the pump 8 has its largest dosaging volume.

The upper part 20 of the pump which is shaped as a double cup continues via a horizontal transverse wall 27 into an upwardly directed vertical collar 28. A mouthpiece 29 is clipped into the collar. This is a dome-shaped basic body with an actuating button 30 inclined downward towards the left side and a mouthpiece opening 31 located on the right side.

A central collar 32 is also formed on the upper part 20 of the pump, the collar extending in the annular space at a distance from the inner surface of the hollow piston 9 and guiding the cross-shaped shaft 33 of an outlet valve V2. The collar 32 starts directly below the transverse wall 27 and forms in its upper end region a valve seat surface 34. The axially somewhat longer valve disk of the outlet valve V2 lies with its lower edge in its normal position with sealing application on the valve seat surface 34. The outlet valve V2 is a so-called soft valve (described in German utility model 88 00 880) which rests with an upper collar 35 of larger cross-section against vertical walls 36 extending from the cover of the dome-shaped mouthpiece 29. The collar 35 has openings in its bottom section extending beyond the circumferential wall so that the pasty composition 2 can freely pass through there. The collar 35 is supported on top with a certain pretension so that the lower rim edge of the valve disk rests against the valve seat surface 34 in sealing application under spring action. The central passage opening 37 of the outlet valve V2 connects the pump space 8 to the mouthpiece opening 31.

A bellows B which forms the restoring spring reaches from the actuation-side hollow piston 9 down to the pump base-side hollow piston 10. It is formed by a folding bellows. Its zig-zag shaped folds 38 extend circumferentially with rotational symmetry. For a stable top-side support on the bottom side of the transverse wall 27 the end fold 38" of the bellows B present there constitutes a simultaneously formed annular body 39 which exceeds the fold wall plane in outward direction. The centering is effected by struts provided in the starting region of the formed hollow piston 9 which, extending in circumferential direction, result in a conical pedestal (FIG. 1) on which the inner turns of the folds 38 can be centered.

With respect to the lower end of the bellows B one proceeds in the manner that the bellows B forms at a vertical distance A from the bottom end or top end of the actuating button-side hollow piston 9 a piston ring K which slides on the wall surface 9' of the hollow piston. The piston ring is seated at the lowest possible end of the hollow piston 9.

The piston ring K is seated directly above the rim edge 18 of the pump base-side hollow piston 10. It is centered there and bridges as a sealing element the radial distance y between the wall surface 9' and the corresponding inner surface 10' of the pump base-side hollow piston 10. In this embodiment there is an annular gap as a result of a slight axial overlapping of both pump-forming elements. As can be noted particularly clearly from FIG. 3, the piston ring K is of greater thickness than the thickness of the wall of the bellows B forming the folds 38. The build up of material is designated as root W.

The rim edge 18 is beveled on the outside so that there is present an incline 40 of about 45° and having rotational symmetry. The incline extends over about half the thickness of the annular wall 12 forming the hollow piston 10 and facilitates placing on the bellows B.

The root W of the piston ring K continues downward into a plug-on collar 41 which is seated on the cylindrical wall surface 10'' of the hollow piston 10 or of its annular wall 12 respectively. The plug-on collar is beveled on its inner edge and imparts a defined position to the lower end of the bellows. In the vicinity of the root W the inner contour of the above-mentioned plug-on collar 41 extends in a manner which takes the incline 40 into account. However, a corresponding inclined wall section 41' also results on the outside. The inclination amounts also in this case to about 45°.

Below the above-mentioned section 41' a horizontally extending annular collar 42 starts on the wall surface-side of the plug-on collar 41. The annular collar also contributes to stabilizing the plug-on section of the bellows; it has a stiffening effect in the manner of a hoop.

The elastic or flexible piston ring K forms two piston ring-sealing lips 43, 44 located axially one behind the other. As can be noted, the sealing lips taper towards their free end and pass there into a transverse rounding. Only the sealing lip 44 is in direct contact with the pump space 8, i.e. with the pasty composition 2 passing through same. Due to the good stripping action of the lower sealing lip 44, the other sealing lip 43 remains substantially without contact with the composition 2. Both sealing lips are pointed towards their free end.

Figure 3:
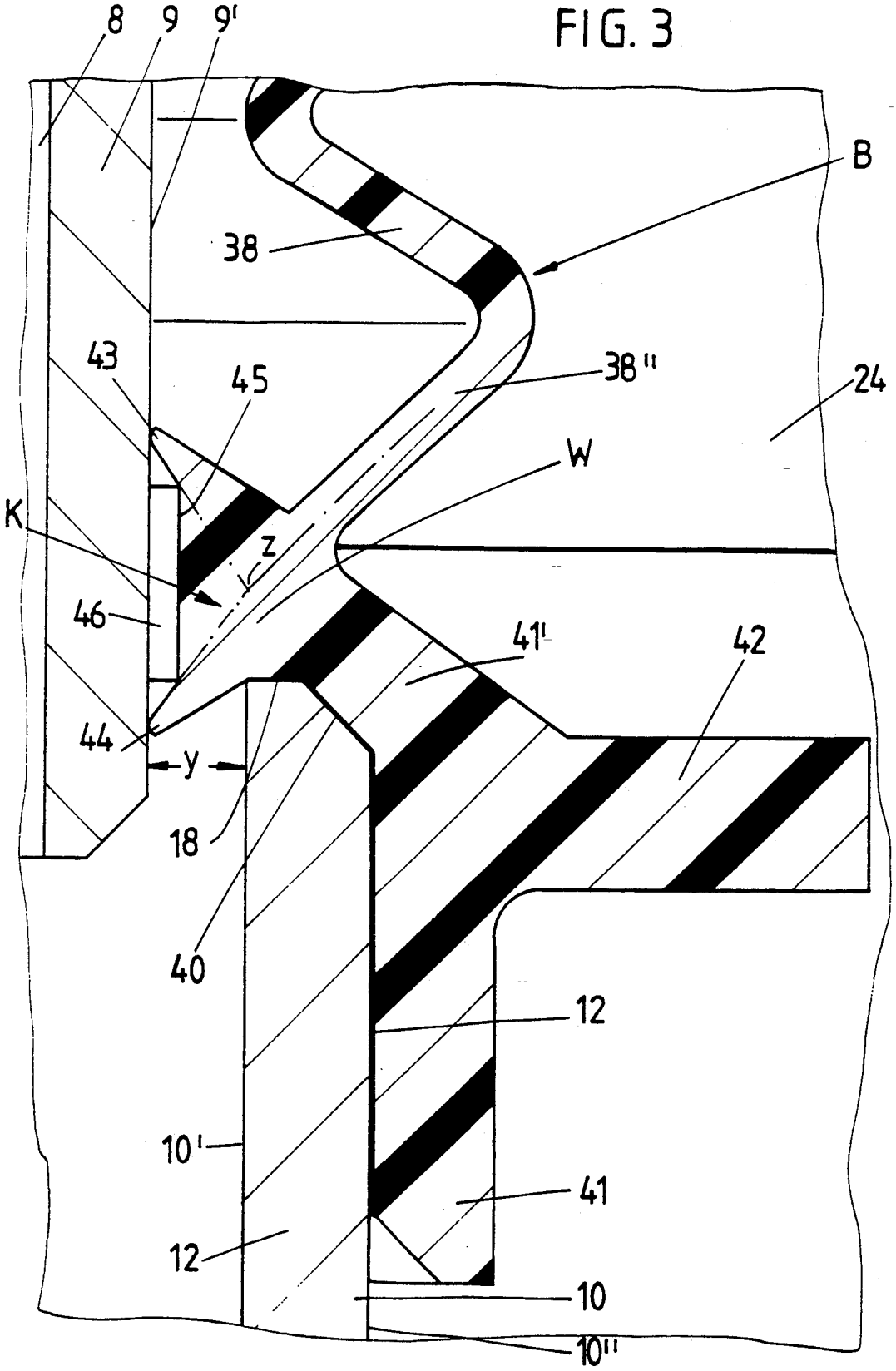
FIG. 3 is another enlarged detail with particular emphasis on the cross-sectional shape of the piston ring formed on the bellows.

As can furthermore be noted from FIG. 3, the two sealing lips 43, 44 are divergent. Referred to the root W, this creates a base 45 with a trapezoidal free space 46 which extends spatially parallel to the cylindrical wall surface 9' of the hollow piston 9. The angle of divergence is about 90°. The fold 38'' of the bellows B which directly extends from the root W is directed towards the divergence apex z. The latter extends substantially in the center of gravity-line of the piston ring K. The divergence apex z lies above the rim edge 18.

Upon folding, the corresponding structure leads to the lower sealing lip 44, which effects the stripping, practically swinging around a fulcrum which is formed by the divergence apex z and which presses it more firmly against the wall surface 9' without, however, the other sealing lip 43 lifting off. The attachment of the piston ring K can take place with slight initial tension, as is true of the bellows in general.

Briefly summarized, the operation takes place as follows:

By the exertion of an actuating force in the direction of the arrow P the pump space 8 is reduced by the two hollow pistons 9, 10 being pushed inside each other. The pasty composition present in the pump space 8 lifts the output valve V2 out of its closing position so that the pasty composition can emerge through the mouthpiece 31. The corresponding actuation is effected against the force of the bellows B which forms a restoring spring. The actuation furthermore takes place with protection of the product as a result of the interposing of the piston ring K described in detail above. The inside pressure prevailing upon actuation closes the inlet valve V1 so that the pasty composition cannot move aside.

When the actuating button 30 is now released after emergence of the strand-shaped pasty composition, the upper part 20 of the pump is restored into the basic position which can be noted from FIG. 1, namely as a result of the force of the bellows B. This produces a vacuum in the pump space 8 which is now being enlarged. This has the result that the outlet valve V2 is closed and the inlet valve V1 is opened. As a result, pasty composition 2 is drawn in from the supply in the housing 1, with the branching off of a dosed quantity. The follow-up piston 5 follows via the filling column of the pasty composition and remains fixed in the new position without giving way.

I claim:

1. A dispenser comprising a pump base disposed at a bottom end of the dispenser, and an actuating button disposed at an upper end of the dispenser opposite the bottom end, the actuating button terminating in a mouthpiece;

pump means disposed between said base and said button, said pump means comprising a first hollow piston extending from said base and a second hollow piston mounted on said button and disposed coaxially to said first hollow piston;

wherein said pump means further comprises a spring body surrounding said second piston and operative to urge said second piston away from said first piston upon release of an external actuating force upon said button, said spring body extending from said base to an upper region of said second piston adjacent said button;

said pump means further comprises an intermediate element having the shape of an annular cap disposed on said base and serving to connect said spring body with said base, said intermediate element making sealing contact with said first hollow piston;

said spring body comprises a bellows integrally formed with said intermediate element, said intermediate element connecting with said bellows at a foot of an annular fold of said bellows; and said pump means further comprises a sealing lip assembly extending toward said second hollow piston from a junction of said intermediate element with said bellows, said junction being at said foot of said annular fold, said sealing lip assembly being directly above an upper edge of said first hollow piston, said intermediate element comprising a push-on collar encircling a top portion of said first hollow piston and extending up to said junction, said foot of said annular fold extending obliquely inwards toward a root portion of said sealing lip assembly.

2. A dispenser according to claim 1, wherein said root portion of said sealing lip assembly contacts said upper edge of said first hollow piston; and said upper edge of said first hollow piston is formed as a rim.

3. A dispenser according to claim 1, wherein said sealing lip assembly serves as a piston ring for sliding along an outer surface of said second hollow piston during relative movement between said first and said second hollow pistons.

4. A dispenser according to claim 3, wherein said sealing lip assembly comprises a first lip and a second lip which encircle said second hollow piston, said second lip being located above said first lip and spaced apart from said first lip.

5. A dispenser according to claim 4, wherein said first and said second sealing lips diverge from each other and leave a trapezoidal free space between themselves, said annular fold of said bellows extending from a common vertex between extensions of surfaces of said first and said second sealing lips.

6. A dispenser according to claim 5, wherein said vertex is located above said upper edge of said first hollow piston.

* * * * *